US006609511B2

(12) United States Patent
Kotsiopoulos et al.

(10) Patent No.: US 6,609,511 B2
(45) Date of Patent: Aug. 26, 2003

(54) CONVEYOR FEED APPARATUS FOR A PAINTBALL GUN

(75) Inventors: Thomas G. Kotsiopoulos, Prospect Heights, IL (US); Eric S. Gibson, Palatine, IL (US)

(73) Assignee: Airgun Designs, Inc., Wheeling, IL (US)

( * ) Notice: Subject to any disclaimer, the term of this patent is extended or adjusted under 35 U.S.C. 154(b) by 0 days.

(21) Appl. No.: 10/046,506

(22) Filed: Oct. 19, 2001

(65) Prior Publication Data

US 2002/0117159 A1 Aug. 29, 2002

Related U.S. Application Data

(62) Division of application No. 09/513,569, filed on Feb. 25, 2000, now Pat. No. 6,305,367.
(60) Provisional application No. 60/121,795, filed on Feb. 26, 1999.

(51) Int. Cl.[7] ..... F41B 11/02

(52) U.S. Cl. ..... 124/51.1

(58) Field of Search ..... 124/49, 51.1

(56) References Cited

U.S. PATENT DOCUMENTS

| | | | |
|---|---|---|---|
| 905,401 | A | 12/1908 | Billmeyer |
| 1,743,576 | A | 1/1930 | Smith |
| 2,091,672 | A | 8/1937 | Cleereman |
| 2,590,981 | A | 4/1952 | Lippert |
| 2,828,732 | A | 4/1958 | Horowitz et al. |
| 2,873,650 | A | 2/1959 | Pinkerton, Jr. |
| 3,244,132 | A | 4/1966 | Leichner et al. |
| 3,318,191 | A | 5/1967 | Reed |
| 3,384,269 | A | 5/1968 | Garrett |
| 3,473,434 | A | 10/1969 | Brieger |
| 3,650,177 | A | 3/1972 | Hupp et al. |
| 3,724,325 | A | 4/1973 | Silsby |
| 3,807,379 | A | 4/1974 | Vodinh |
| 3,855,988 | A | 12/1974 | Sweeton |
| 3,878,827 | A | 4/1975 | Newgarden, Jr. |
| 4,023,465 | A | 5/1977 | Inskip |
| 4,034,644 | A | 7/1977 | Hupp et al. |
| 4,116,192 | A | 9/1978 | Scott |
| 4,126,079 | A | 11/1978 | Perrine |
| 4,147,152 | A | 4/1979 | Fischer et al. |
| 4,207,857 | A | 6/1980 | Balka, Jr. |
| 4,292,878 | A | 10/1981 | Brooks et al. |
| 4,328,737 | A | 5/1982 | Nelson et al. |
| 4,348,938 | A | 9/1982 | Gillum |

(List continued on next page.)

FOREIGN PATENT DOCUMENTS

| | | |
|---|---|---|
| GB | 2271833 A | 4/1994 |
| GB | 2322438 B | 8/1998 |
| JP | 10-118308 A | 5/1998 |

OTHER PUBLICATIONS

Search Report; Application No. GB 0112887.5; date of search: Aug. 29, 2001.

*Primary Examiner*—John A. Ricci
(74) *Attorney, Agent, or Firm*—Leydig, Voit & Mayer, Ltd.

(57) ABSTRACT

The present invention provides jam prevention systems for use with a paintball gun having a hollow infeed portion for receiving paintballs to be fired by the gun. The jam free feeder system generally includes a housing, a feed tube, a jam free feeder system, a sensor and a controller. The housing stores a quantity of paintballs. The feed tube is connected to the hollow infeed portion of the housing. The connected feed tube forms a paintball feed passageway for receiving and holding a stack of paintballs and sequentially delivering the paintballs to the paintball gun. A jam free feeder is provided, which is selectively operable to prevent jamming of paintballs in the housing. The sensor senses the firing of the paintball gun and a controller operates the jam free feeder in response to the firing of the paintball gun. Embodiments where the jam free feeder system is a hopper feeder system or a conveyor system are also provided.

11 Claims, 6 Drawing Sheets

U.S. PATENT DOCUMENTS 4,434,700 A 3/1984 Aloi et al.
4,523,509 A 6/1985 Thevis et al.
4,566,580 A 1/1986 Aloi et al.
4,616,622 A 10/1986 Milliman
4,817,955 A 4/1989 Hickson et al.
4,819,609 A 4/1989 Tippmann
4,881,447 A 11/1989 Yanusko et al.
4,936,282 A 6/1990 Dobbins et al.
4,986,251 A 1/1991 Lilley
4,993,400 A 2/1991 Fitzwater
5,070,762 A 12/1991 Long et al.
5,097,985 A 3/1992 Jones
5,280,778 A 1/1994 Kotsiopoulos
5,282,454 A 2/1994 Bell et al.
5,335,579 A 8/1994 David
5,349,939 A 9/1994 Perrone
5,383,442 A 1/1995 Tippmann
5,413,083 A 5/1995 Jones
5,456,153 A 10/1995 Bentley et al.
5,497,758 A 3/1996 Dobbins et al.
5,505,188 A 4/1996 Williams
5,511,333 A 4/1996 Farrell
5,561,258 A 10/1996 Bentley et al.
5,572,982 A 11/1996 Williams
5,709,199 A 1/1998 Johnson et al.
5,722,383 A 3/1998 Tippmann, Sr. et al.
5,736,720 A 4/1998 Bell et al.
5,791,325 A 8/1998 Anderson
5,794,606 A 8/1998 Deak
5,809,983 A 9/1998 Stoneking
5,816,232 A 10/1998 Bell
5,839,422 A 11/1998 Ferris
5,881,962 A 3/1999 Schmidt et al.
5,915,590 A 6/1999 Yeh
5,947,100 A 9/1999 Anderson
5,954,042 A 9/1999 Harvey
6,055,975 A 5/2000 Gallagher et al.
6,109,252 A 8/2000 Stevens
6,305,367 B1 10/2001 Kotsiopoulos et al.
6,327,953 B1 12/2001 Andresen

CONVEYOR FEED APPARATUS FOR A PAINTBALL GUN

CROSS REFERENCE TO RELATED APPLICATIONS

This application is a division of prior application Ser. No. 09/513,569, filed Feb. 25, 2000 now U.S. Pat. No. 6,305,367 which claimed priority to U.S. Provisional Patent Application Serial No. 60/121,795, filed Feb. 26, 1999, the disclosures of which are incorporated herein in their entirety.

FIELD OF THE INVENTION

The present invention generally relates to paintball guns, and more particularly relates to feeder apparatuses used in feeding of a stored supply of paintballs to the infeed opening of a paintball gun.

BACKGROUND OF THE INVENTION

The game of paintball is one in which two or more "military" teams try to capture one another's flags. The players on the teams each carry a compressed gas-powered gun that shoots paintballs—gelatin or plastic spherical capsules which contain a colored liquid. When a player is hit with a paintball from an adversary's gun, the paintball ruptures and leaves a colored "splat" on the hit player who is then "out" and must leave the game.

As the game of paintball has grown in sophistication, semiautomatic paintball guns—guns that sequentially fire individual paintballs as fast as the trigger can be repeatedly pulled—have become more prevalent. The high firing rate capability of semiautomatic paintball guns has necessitated the use of bulk loader devices in conjunction with such guns.

A hopper feeder is normally adapted to internally store a relatively large quantity of paintballs (for example 100–200 paintballs) and has a bottom outlet opening through which the stored paintballs can sequentially drop. Connected to the housing over its bottom outlet opening, and extending downwardly therefrom, is a feed tube that is connectable to the gun's hollow infeed.

During normal operation of the loader, paintballs dropped through its housing outlet opening form a paintball stack, within the feed tube and gun infeed, that is fed to the gun during firing. Paintball jams intermittently occur within the hopper-housing during firing of the gun. These jams prevent the normal delivery of paintballs downwardly through the housing outlet opening, with the result that the paintball stack can be totally depleted by several shots of the gun.

In the past, clearing of such jams has required that the gun be forcibly shaken to dislodge the paintballs causing the jam within the loader housing. Such a solution is undesirable since it interrupts the proper aiming of the paintball gun and, of course, correspondingly interrupts the gun user's ability to continue the rapid firing of the gun.

SUMMARY OF THE INVENTION

The present invention provides jam prevention systems for use with a paintball gun having a hollow infeed portion for receiving paintballs to be fired by the gun. The jam free feeder system generally includes a housing, a feed tube, a jam free feeder system, a sensor and a controller. The housing stores a quantity of paintballs. The feed tube is connected to the hollow infeed portion of the housing. The connected feed tube forms a paintball feed passageway for receiving and holding a stack of paintballs and sequentially delivering the paintballs to the paintball gun. A jam free feeder is provided, which is selectively operable to prevent jamming of paintballs in the housing. The sensor senses the firing of the paintball gun and a controller operates the jam free feeder in response to the firing of the paintball gun. In more specific embodiments both hopper feeder and conveyor systems are provided. Both systems detect, and operate in response to each firing of the paintball gun.

The hopper feeder system comprises a housing, a feed tube, and an agitator. The housing is a container suitable for internally storing a quantity of paintballs. The housing has a bottom outlet opening through which the stored paintballs may sequentially drop. The feed tube is connected to the bottom outlet opening and connects the housing to the gun forming a feed passageway. The feed tube receives and holds a stack of paintballs dropped through the bottom outlet opening and sequentially delivers the paintballs to the gun in response to each firing of the gun. An agitator is disposed in the housing and is selectively operable to prevent a paintball feed jam by shifting some of the paintballs in the housing positioned adjacent the bottom outlet opening to prevent a jam as the paintballs exit through the bottom outlet opening into the feed tube.

Additional hopper feeder aspects of the invention provide a bulk loader apparatus for supplying paintballs to the gun, which is generally positionable above the gun. A hopper feeder apparatus includes a power source and a switch. The power source powering operation of the sensor, the controller and the agitator, and wherein the power source is operably controlled by the switch. The agitator preferably has a rotatable agitator paddle, more preferably with upward slanting sidewalls on the outside rim of the paddle.

The present invention further provides a conveyor feed system. The conveyor feed system includes a housing and a conveyor for transmitting paintballs out of the housing and into the gun. The conveyor includes holders (e.g., paddles) spatially separated for holding and transmitting the paintballs from the lower end of the paintball stack to the feed tube in response to firing of the gun.

Preferably, two conveyor feeds are provided. The conveyors spin in opposite directions, wherein the conveyors are positioned adjacent to this tube with the holders attached thereto protruding into the tube. The paintballs are transmitted from the lower end of the paintball stack to the paintball gun in response to each firing of the gun. The housing can be positioned around the gun or separate from the gun.

Both feeder systems of the present invention include a sensor and a controller. The sensor senses the firing of the paintball gun and a controller responsively operates the jam free feeder system to prevent any paintball jam. Preferably, the sensor is selected from the group consisting of an accelerometer, sound detector and a pressure sensor. More preferably, the sensor and control are a single component. Both aspects of the invention also can include a liquid crystal display.

DETAILED DESCRIPTION OF THE INVENTION

Figure 1:
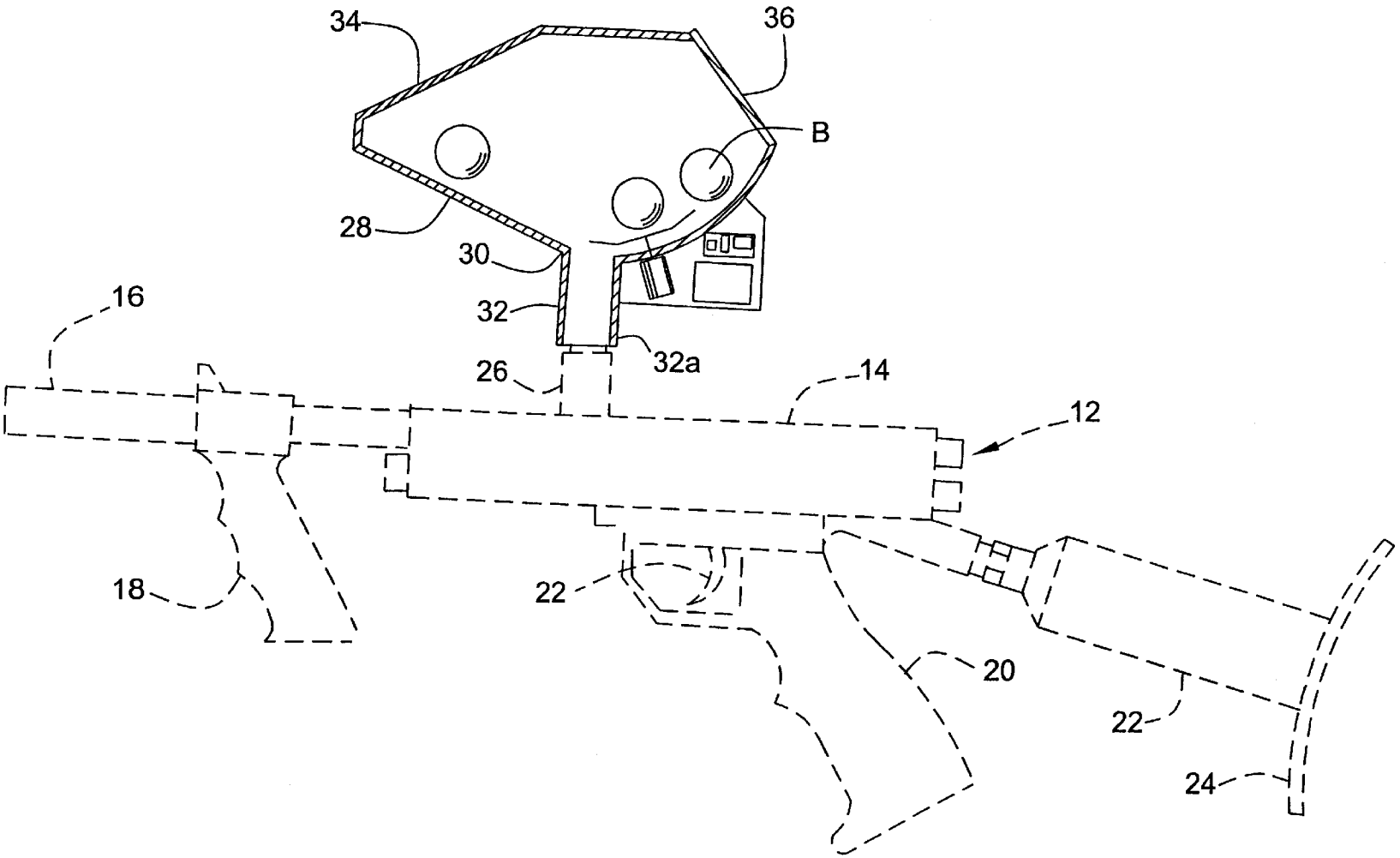
FIG. 1 is a side elevational view of a hopper feeder which embodies principles of the present invention operatively attached to a representative paintball gun illustrated in phantom.

In carrying out principles of the present invention an essentially jam free hopper feeder apparatus is provided for use with a paintball gun. The jam free hopper feeder apparatus can take the form of either a gravity hopper feeder or a conveyor hopper feeder apparatus. Representatively, the paintball gun with which the jam free hopper feeder is used is a semiautomatic gun having a hollow infeed portion, which is adapted to receive a supply of paintballs from a source thereof and sequentially deliver the received paintballs to the gun, to reload it, in response to firing the gun.

The hopper feeder apparatus includes a housing for internally storing a quantity of paintballs. In gravity hopper feeders the housing has a bottom outlet opening through which the stored paintballs may sequentially drop. A feed tube is connected to the housing over the bottom outlet opening and extends downward from the outlet opening. The feed tube is connected to the gun infeed forming a paintball feed passageway for receiving and holding a stack of paintballs. Paintballs pass through the housing bottom outlet opening and sequentially delivered to the firing chamber. The paint balls are gravity fed into the feed tube from the hopper to the gun. In such aspects, the hopper feeder can be placed in any suitable position generally above the gun to achieve gravity feeding.

A specially designed jam preventing system is incorporated in the gravity hopper feeder apparatus. The jam preventing system includes an agitator disposed in the housing. The agitator can be selectively operated to clear a paintball feed jam in the housing. The agitator accomplishes this by shifting one or more paintballs positioned at or near the bottom outlet opening to prevent the paintballs from jamming the housing and outlet.

The agitator includes an agitator paddle positioned within the housing. The agitator paddle rotates in a manner such that an end portion of the paddle sweeps across an interior section of the housing directly above the housing outlet opening. The agitator paddle is rotationally driven, for example through a gear train, by a motor, such as a small direct current electric motor.

The present invention also provides a conveyor feed apparatus. The conveyor feed apparatus includes a housing and one or more conveyors. The conveyor includes holders (e.g., paddles) spatially separated along the conveyor for holding and transmitting the paintballs from the lower end of the housing into the feed tube in response to each firing of the gun. A motor drives the operation of the conveyors. The paintballs moving through the housing eventually drop onto the conveyor and are transmitted from the lower portion of the housing through a feed tube and into the gun by the positive movement of the conveyor. In a one conveyor system, paintballs drop onto the conveyor belt between the holders and are transported by the conveyor system to the feed tube.

Preferably, the conveyor feed apparatus includes two conveyors positioned parallel to each other forming a channel in between. Each conveyor includes a conveyor belt, wheels and holders (e.g., paddles). Preferably, the conveyors have drive wheels and free spinning wheels, the drive wheels rotating in opposite directions to move the holders in a uniform direction through the channel. The paintballs fall into a channel formed between the two conveyors and are held within the space formed between the holders. The paintballs are transmitted through the housing to the feed tube, and subsequently to the gun's infeed. The feed tube can enter the gun from any position (e.g., top, side or bottom).

Both aspects of the invention also include a sensor for sensing the firing of the paintball gun and a controller for responsively operating the system (either the agitator or conveyor) to prevent paintball jam. Preferably, the sensor and control are a single unit or component. The control can be any suitable control for operating the jam operating system. The sensor can be any suitable sensor. For example, the sensor can be an accelerometer, a pressure sensor, a sound detector, or any other detector capable of detecting the firing of the paintball gun. Accordingly, the jam preventing system automatically operates on each firing of the paintball gun maintaining paintballs in the housing until all available paintballs are fired.

Both aspects of the present invention also include a motor for driving the components of the invention (e.g., the conveyor or agitator paddle). Preferably, the motor is supported on the underside of the housing and powered by a battery, such as a DC battery, also supported on the housing underside. Typically, the motor and battery are connected in series in a DC electrical circuit provided with a main on/off switch operable to selectively turn the jam preventing system on and off. In the conveyor where two conveyors are provided, either a single motor with suitable gearing or two separate motors can be used to drive the conveyors.

For purposes of an understanding of the invention, reference will now be made to the apparatus as shown in the figures and specific language will be used to describe the same. It will nevertheless be understood that no limitation of the scope of the invention is thereby intended, and that the apparatus shown therein represents only some of the features of the claimed invention.

Illustrated in FIG. 1 is an exemplary hopper feeder apparatus that embodies principles of the present invention and is operatively connected to a representative paintball gun 12 of conventional construction and operation, the paintball gun being shown in phantom. The paintball gun 12 is representatively of the semiautomatic firing type and has a body portion 14; a barrel 16 with a front handgrip 18 depending therefrom; a central handgrip 20 having a trigger 22; and a rear stock portion defined by a $CO_2$ propellant gas canister 22 and provided at its rear end with a crooked shoulder rest portion 24.

The paintball gun is conventionally fitted with an infeed portion in the form of a hollow, open-ended infeed. In a manner subsequently described, paintballs stored within the hopper 10 are gravity fed downwardly into the firing chamber for sequential firing from the gun by pressure bursts from canister 22 created by sequential pulls of the trigger 22.

While the present invention is described here with reference to a paintball gun having the previously mentioned features, it will be clear that it can be used with any type of paintball gun, such as tournament-level paintball guns which use compressed gas and do not have stocks.

Figure 2:
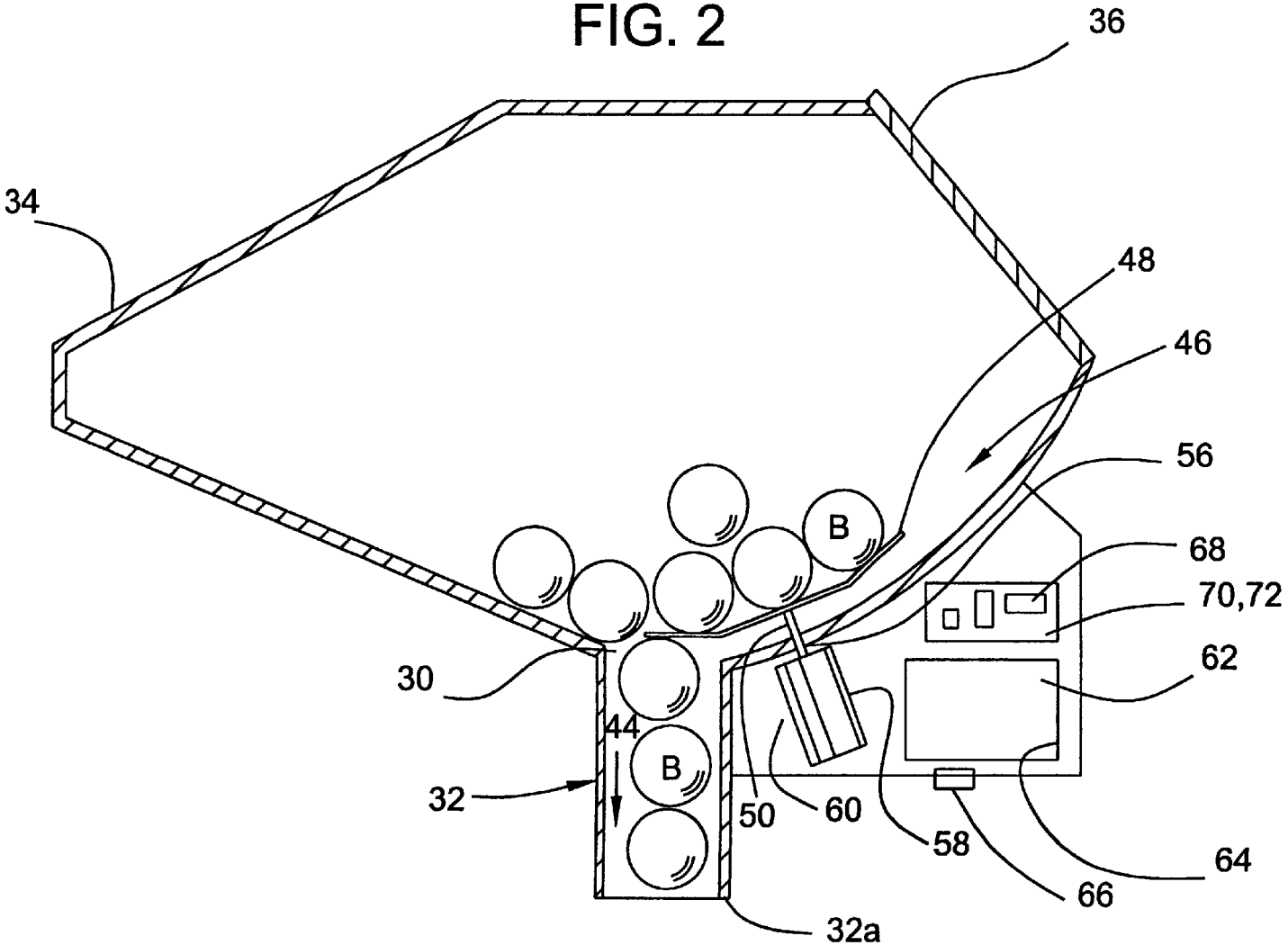
FIG. 2 is an enlarged scale, partially cut away side elevational view of the gravity hopper feeder during normal paintball feeding thereof to the gun.

Referring now to FIGS. 1–2, the hopper feeder has a hollow housing 28 positioned above the gun body 14 and adapted to internally receive and store a quantity of paintballs B. Housing 28 is conveniently of a molded plastic construction and is bent along a downwardly curved longitudinal axis. Housing 28 has a closed front end 34 and rear opening 36 which is covered by a hinged lid through which paintballs are loaded in the hopper. An outlet opening 30, preferably circular, is formed in the bottom side of the housing 28. The outlet opening 30 has a diameter or is otherwise somewhat larger than the diameters of the stored paintballs B, so that the paintballs can sequentially drop downwardly through opening 30 into a feed tube portion 32 of the gravity hopper feeder. The feed tube 32 is secured to housing 28, over its outlet opening 30, and extends generally downwardly from the housing 28. The housing 28 is connected to the paintball gun 12, by the feed tube 32, more particularly by the feed tube's lower end portion 32*a,* which is preferably removably received by the gun 12.

Turning now to FIG. 2, during normal operation of the paintball gun, the housing-stored paintballs B sequentially fall downwardly through the housing bottom outlet opening 30 and form a paintball stack within the feed tube 32 and the gun infeed 26 to which the feed tube is removably connected. As the paintball gun is repeatedly fired, the paintballs moves downwardly into the gun, as indicated by the arrow 44, and are continuously replenished at the top end of the feed tube 32 by additional paintballs B falling through the housing outlet opening 30.

Paintball jams are prevented via an automatic jam preventing system generally designated by the reference numeral 46. The jam prevention system 46 includes an agitator paddle 48 disposed within the housing 28 outwardly adjacent its outlet opening 30 and centrally supported on a shaft 50 for driven rotation within the housing. When the member 48 is rotationally driven in this manner, its outer ends sweep intermittently through an interior section of the housing 28 positioned above an outer portion of the housing outlet opening 30 as viewed in FIG. 2.

The shaft 50 extends downwardly through a small opening in the bottom side of the housing 28 and is connected to the output shaft 56 of a small electric motor 58 disposed within a casing 60 secured to the underside of the housing 28 behind the feed tube 32. Motor 58 is powered by a small DC storage battery 62 disposed within a casing 64 supported on the underside of housing 28 behind casing 60. The two casings 60 and 64 can be combined into a single storage area. The jam preventing system 46 may be selectively activated and deactivated using a manual on/off switch 66 externally mounted on casing 60.

System 46 also includes a sensor 68 such as an accelerometer, a sound detector, a pressure sensor, or other suitable detector, which detects the firing of the paintball gun. Such sensors are of a conventional construction and have emitter and receiver/switch portions 70, 72. The sensor is preferably combined with a control, such as a control circuit. The motor 58, the battery 62, the on/off switch 66 and the sensor 68 are electrically connected in series with one another. The sensor, control, motor, battery and switch can be used in either aspect of the present invention, and are further described elsewhere herein.

With the on/off switch 66 in the on position to activate the jam preventing system 46, the sensor 68 detects the firing of the paintball gun. The rotationally driven agitator member 48 is actuated and engages and stirs the paintballs in the housing near the outlet 30. The stirring prevents jamming of the paintballs ensuring that they fall through the outlet opening 3 onto the top of the paintball stack S, as indicated by the dotted line positions of the paintballs $B_1$ and $B_2$. The agitator runs for about 0.5 seconds although the exact time period is not critical to the invention and shuts off automatically. Each time the trigger is activated and the sensor detects a firing the agitator is activated. Preferably, the feed tube is filled to aid the transport of paintballs between the housing and the paintball gun. The operation of the system maintains jam free feeding of the paintballs into the feed tube, and subsequently to the paintball gun for firing.

Figure 3:
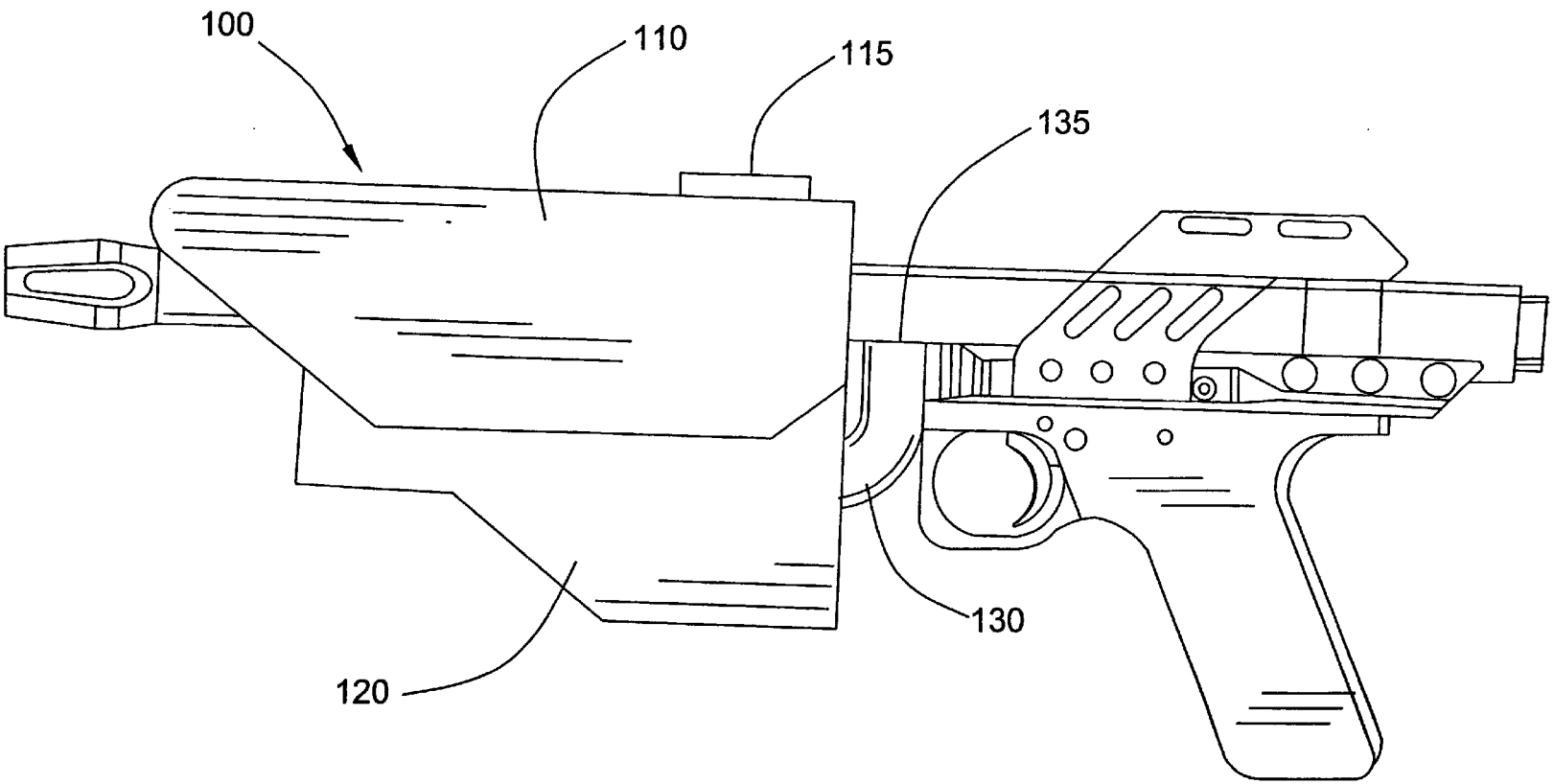
FIG. 3 is an exterior view of a paintball gun incorporating a conveyor hopper feeder apparatus of the present invention.

In a second embodiment, a conveyor feed system is provided, as shown in FIG. 3. The conveyor feed system includes a housing 110, the lower portion 120 of which contains a conveyor feed (not shown). The conveyor feed system transmits paintballs from the bottom of the housing 120 through a feed tube 130 and into the gun 100. Due to the positive motion of the conveyor feed system, the feed tube 130 can enter the gun 100 in any orientation. For example the feed tube 130 can exit the housing at a point lower than the point of entry 135 into the gun, as shown in FIG. 3.

Due to the positive motion provided by the conveyor feed system, the conveyor feed system can be positioned at various positions with respect to the gun (i.e., not necessarily above the gun). For example, the housing can be positioned to the side of the gun or around the body of the gun, with a feed tube positioned at the bottom of the housing and travelling upward to enter the gun. In such aspects, the housing may be less subject to protrusion in the gun operators line of sight, which might otherwise block the gun operator's vision. Furthermore, by lowering the housing more in line with the paintball gun, the target area of the player with the gun is comparatively reduced. Further, the conveyor feed system only requires contact with the paintball gun by the feed tube. Conveniently, the conveyor feed system can be readily removed from the immediate proximity of the gun and be placed in, for instance, a backpack unit, reducing the total area of the gun available to an opponent's fire and making the gun less awkward to carry.

Figure 4A:
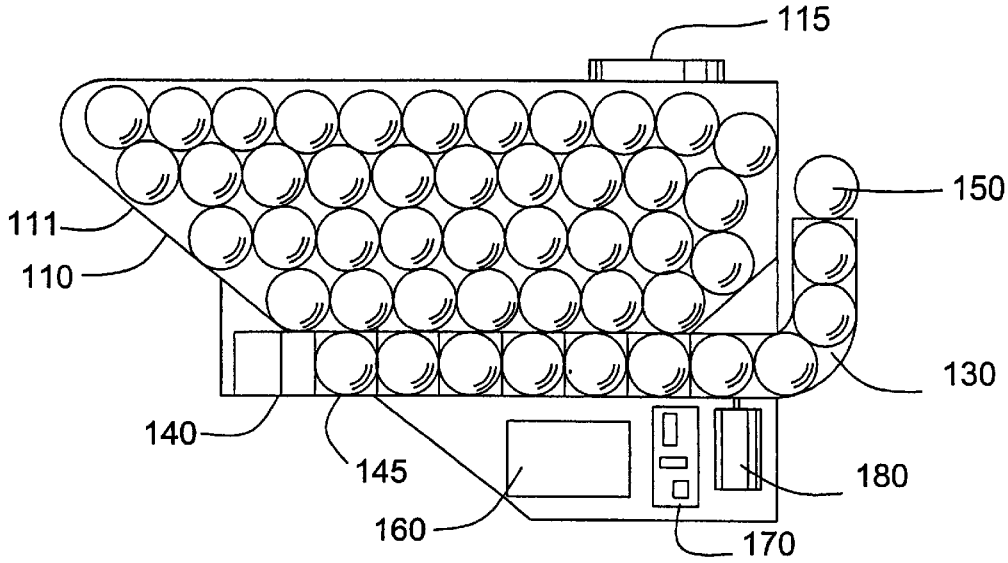
FIG. 4A is a side cutaway view of a conveyor feed aspect of the present invention.

FIG. 4A shows a side cutaway view of an exemplary conveyor feed system of the present invention. The gun operator feeds paintballs into the housing through an inlet 115. Preferably, the housing includes a cover (not shown), which closes the inlet. The paintballs in the housing 110 typically move gravitationally to the lower portion 120 of the housing. In the housing's lower portion 120, the paintballs either fit within the spaces formed by the holders 140 which are attached to the conveyor (not show) or are held in the housing lower portion above the balls held within the holders 140.

Figure 4B:
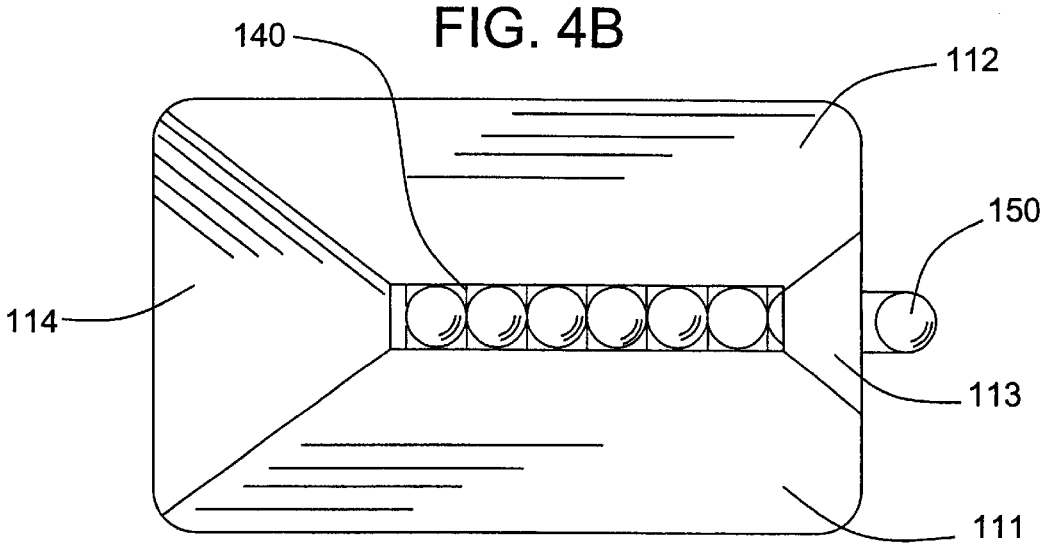
FIG. 4B is a cutaway top view of the of the conveyor feed aspect shown in FIG. 4A.

Typically, the shape of the housing will control the way that the paintballs will drop between the holders, improving the efficiency of the system in avoiding jams and providing paintballs to the gun. Preferably, the only area that is exposed in the bottom of the housing is the channel formed between the conveyors where the paintballs are transported by the holders, as seen in FIG. 4B. For example, the housing 110 can be shaped such that slanting side walls 111 and 112 are sloped to guide paintballs to the conveyor as they approach the bottom of the housing. Additionally, sloping sections in the front 113 and rear 114 of the housing additionally guide the paintballs through the housing to the conveyor promoting efficiency of the system in reducing jams. The housing can take any suitable shape and orientation. For example, the upper portion of the housing can be divided into two portions where it is desired to place the housing below and around the gun.

Figure 6:
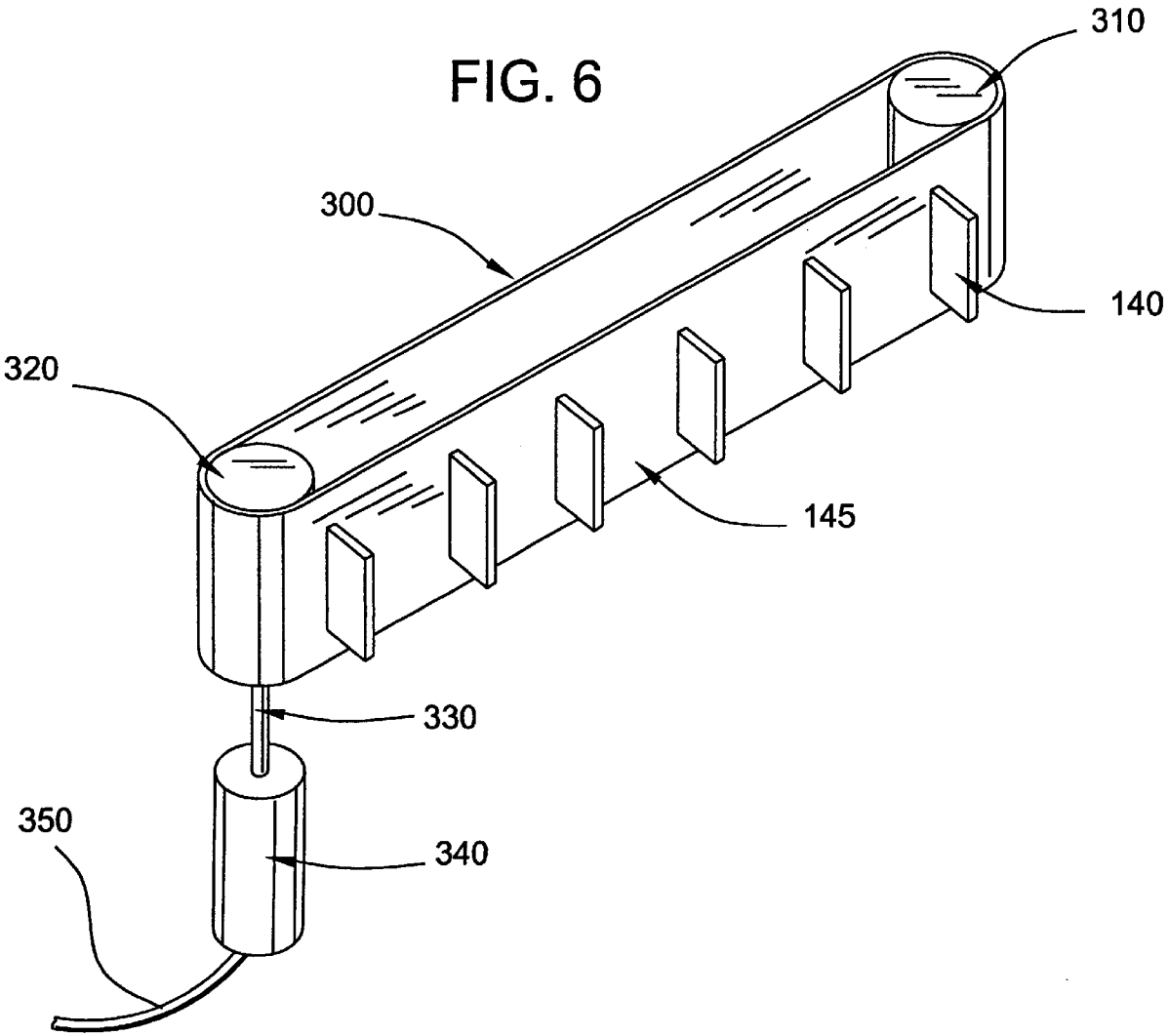
FIG. 6 is a tiled side view of a conveyor system of the invention.

In a single conveyor belt system, after the paintballs are guided to the bottom of the housing 110, they fall onto the conveyor belt 145 between the holders 140. The conveyor system can be any suitable conveyor system for moving paintballs through the bottom of the housing and into the feed tube (and preferably into the housing thereafter). Preferably, the conveyor system consists of a conveyor belt 145, two wheels (not shown) and a number of holders 140 (e.g., paddles) extending from the surface of the belt 145, as seen in FIG. 4A and FIG. 6. As shown in the exemplary conveyor system 300 in FIG. 6, it is preferred that one wheel is driven wheel 320 and the other wheel a free spinning wheel 310. The conveyor belt 145 can be any suitable conveyor belt. Suitable conveyor belts should have enough tension from the wheels to make the conveyor belt rotate with the driven wheel 320. The driven wheel 320 is attached to a drive shaft 330, which is attached to a motor 340, such as a DC motor as described elsewhere herein, which is further attached by a connector 350 to a power source, such as a battery.

The holders 140 can be of any suitable type of holder for transmitting the paintballs, such as conveyor paddles. Preferably, the holders 140 are capable of flexing at pressures lower than the force required for breaking a paintball, but are sufficiently sturdy enough to move the paintballs through the housing and into the gun. The number of holders attached to the conveyor belt will depend upon the length of the conveyor system, and the type of paintball that the system uses. One of ordinary skill in the art will readily be able to select a conveyor with an appropriate number of paddles based upon these two factors.

Figure 4C:
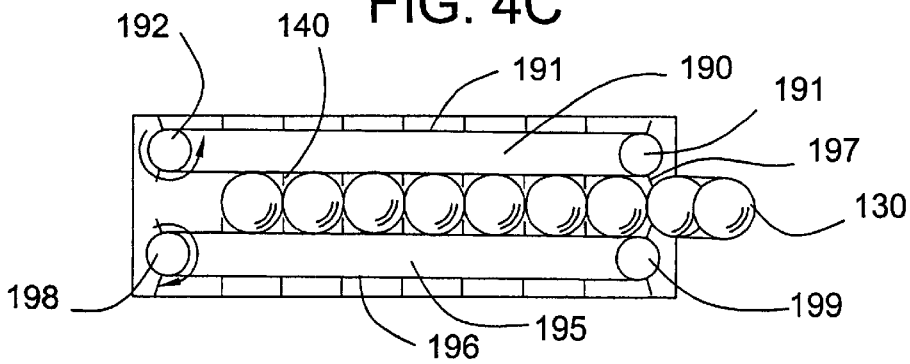
FIG. 4C is a top cutaway view of a conveyor feed aspect of the present invention incorporating two conveyor belts.

FIG. 4C provides a top cutaway view of an alternate conveyor feed system of the invention, focusing on the conveyor system therein. In this system, the conveyor system comprises a first conveyor 190 and a second conveyor 195, in contrast to the single conveyor system previously described. A first conveyor belt 191, attached to the first conveyor 190, moves in a first orientation (e.g., clockwise), through the operation of a first drive wheel 192 and a first free spinning wheel 191. A second conveyor belt 196 is attached to a second conveyor 195 and moved around a second drive wheel 198 and a second free spinning wheel 199. The second conveyor belt 196 runs parallel to the first conveyor system but moves in a second opposite orientation, to move the holders 140, and thus the paintballs, in the same direction, through the bottom of the housing 120 to the feed tube 130.

In operation of the conveyor feed system of the invention, paintballs move and/or are guided to the conveyor belt 145 in a single conveyor system, or the channel formed between two conveyors 197, in a two conveyor system. The moving holders 140 then transport the paintballs through the bottom of the housing 120 and force the paintballs into the feed tube 130. Preferably, the feed tube 130 is filled prior to operation to aid in the transport of the balls between the housing and the paintball gun. The paintballs are subsequently transported through the feed tube into the gun at the paintball gun's infeed 150. As paintballs move out of the housing 110, other balls contained in the lower portion of the housing are permitted to fall between the holders, thus preventing jams in the housing. Due to the positive motion of the conveyor, versus the passive gravity feed in other aspects of the invention, the conveyor feed approximately doubles the rate of transferring paintballs from the housing to the gun. More particularly, the conveyor feed of the present invention can feed paintballs at a rate of up to about 26 paintballs per second, compared to about 13 paintballs per second for hopper feeder systems. The conveyor feed system is operated by a sensor and control, which preferably form an integrated unit, that detect the firing of the paintball gun and operates the system, preferably for a set period of time, in response to each firing.

Figure 5A:
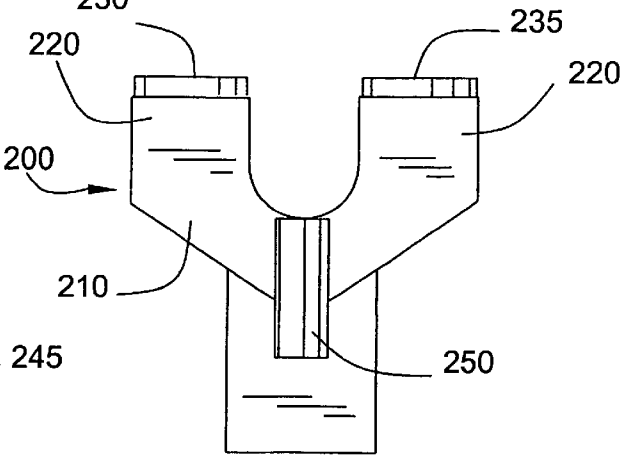
FIG. 5A is a rear view of an alternate conveyor feed embodiment of the invention, having two upper housing chambers.
Figure 5B:
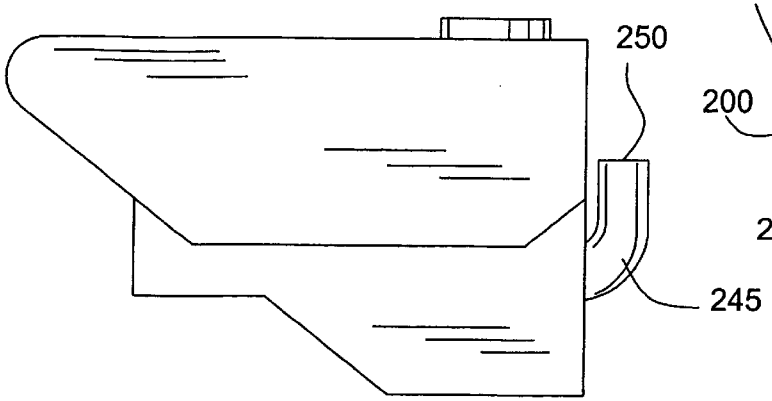
FIG. 5B is a side view of the alternate embodiment shown in FIG. 5A.
Figure 5C:
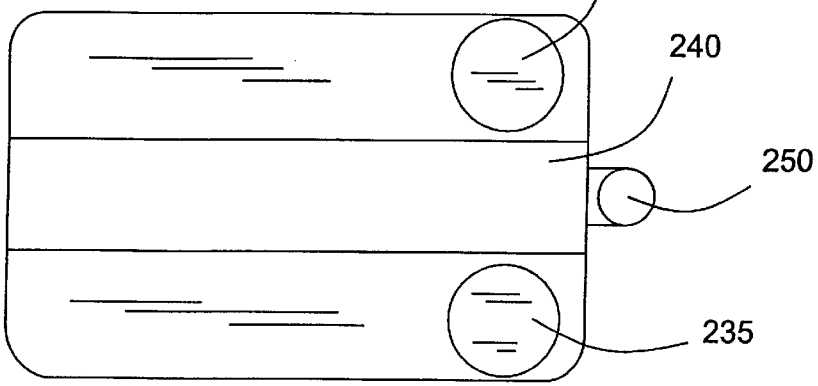
FIG. 5C is a top view of the alternate embodiment shown in FIG. 5A.

The housing can take any suitable shape in the context in the present invention. Typically the housing will comprise a single chambered hopper, as shown in, for example, FIG. 1. FIGS. 5A, 5B and 5C show an alternative aspect of the present invention 200, wherein the housing 210 includes a first upper housing chamber 220 and a second upper housing chamber 225, positioned on opposite sides of a conveyor feed system 240. The first upper housing chamber 220 is provided with an opening 230, and the second housing chamber 225 is provided with a separate opening 235, each for feeding paintballs into the feeder portion of the housing. In such an embodiment the first upper housing chamber 220 and second upper housing chamber 225 preferably slant downward at the lower ends thereof and direct the paintballs to the conveyor feed 240, to promote efficiency of the system in preventing jamming and delivering paintballs to the gun's infeed 250 by way of the feed tube 245.

A sensor and control unit 170 senses the firing of the gun and a control controls the operation of the system. Preferably, the sensor and control unit (alternatively referred to as either the sensor or the control with reference to the integrated sensor and control unit 170) is a single integrated unit, as seen in, for example, FIG. 4A. Although shown as a combined component, the sensor and control can be separate components. The sensor 170 can be any sensor which can maintain the control of the conveyor, such as the sensors described above with reference to activating the jam preventing system 46. For example, the sensor 170 can be an accelerometer, preferably which is mounted in the housing. The accelerometer detects the shock/recoil of the gun when it is fired and can be set to pick up a specific range of force, and a set duration. By programming the accelerometer sensor in such a fashion, the feeder will not activate when the feeder is dropped, but only when fired. Accelerometers and their control are well known in the art, and one of ordinary skill in the art will readily be able to select an appropriate type and settings for use in a feeder system of the present invention. A particularly preferred accelerometer is a single access accelerometer, model number ADXL150, commercially available from Analog Devices.

Alternatively, as described herein, a sensor which detects sound can be utilized. Such a sensor would be set to detect specific decibel levels and frequency, which would trigger the operation of the feeder. An other alternative is a sensor directed to pressure. Such sensors would typically utilize a remote pitot tube to pick up pressure that is escaping the gun and causing the operation of the feeder when a particular pressure is reached. The control (or control circuit), is preferably a component of a combined sensor-control, and will preferably include a timer that activates the conveyor feed, or agitator, for a set time period after the sensor triggers the operation of the control circuit.

A motor 180 drives the operation of the conveyor in response to the control. Any suitable motor can be used in the present invention. Preferred motors are small lightweight motors that can be contained in the housing, such as motors similar to those used in remote control cars. Several lightweight and suitable motors are known in the art, and one of ordinary skill in the art will readily be able to determine a suitable motor. Preferably, as shown, a battery 160, such as a DC battery, powers the motor. The movement of the conveyor, as controlled by the control, effects movement of a new paintball into firing position each time the gun is fired and prevents jams. As previously mentioned, unless otherwise expressed or clear from context the principles applicable to the motor, battery, sensor and control for both aspects of the invention are the same, and thus references to these elements elsewhere herein are applicable to the aspects of the invention described immediately above, and visa versa.

Since the system, in either aspect described above, is operated only in response to the firing of the paintball gun and then automatically shuts off, battery power is efficiently utilized, thereby advantageously prolonging the operating life of the battery. When the gun is to be transported or stored, the switch is simply turned off to prevent the unintended activation of the jam preventing system. The system is of a simple, rugged, and relatively inexpensive construction, yet reliably provides for automatic, paintball jam prevention without the previous necessity of manually shaking the gun and thereby disrupting both the aiming and firing thereof.

Given the addition of power via battery to the gun, further electronic features may be added to the hopper feeder of the present invention. For instance, a liquid crystal display (LCD) may be added which displays various recorded or measured values to the user. For instance, since the gun sensor is actuated by firing, an additive circuit may be employed which tracks number of shots fired and rate of firing in cooperation with a built in timer. Further, where a preset number of paintballs are added to the hopper, the circuitry may enable a tracking such that the number of remaining paintballs may be tracked. Further, a timer may be used to disclose the remaining time or elapsed time in a game. Any or all of such information may then be displayed on the LCD.

All references, including publications, patent applications and patents, cited herein are hereby incorporated by reference to the same extent as if each reference were individually and specifically indicated to be incorporated by reference and were set forth in its entirety herein. The use of the terms "a" and "an" and "the" and similar referents in the context of describing the present invention (especially in the context of the following claims) are to be construed to cover both the singular and the plural, unless otherwise indicated herein or clearly contradicted by context. The use of terms "including", "having" and "comprising" all are open ended equivalent terms meaning including, but not limited to, unless otherwise indicated herein. The use of any and all examples, or exemplary language (e.g., "such as") provided herein is intended merely to better illuminate the present invention does not pose a limitation on the scope of the claimed invention. No language in the specification should be construed as indicating any non-claimed element as essential to the practice of the invention.

The foregoing is an integrated description of the invention as a whole, not merely of any particular element of facet thereof. The description describes "preferred embodiments" of this invention, including the best mode known to the inventors for carrying it out. Of course, upon reading the foregoing description, variations of those preferred embodiments will become obvious to those of ordinary skill in the art. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is possible unless otherwise indicated herein or otherwise clearly contradicted by context.

What is claimed is:

1. A conveyor feed apparatus for use with a paintball gun having an infeed portion for receiving paintballs to be fired by the paintball gun, comprising:

a housing for internally storing a quantity of paintballs, and a conveyor comprising a conveyor belt for receiving paintballs from said housing and transmitting said paintballs from said housing to said paintball gun in response to firing of said paintball gun.

2. The conveyor feed apparatus of claim 1 further comprising a sensor for sensing the firing of the paintball gun and a controller for responsively operating said conveyor.

3. The conveyor feed apparatus of claim 2, wherein said sensor is selected from the group consisting of an accelerometer, sound detector and a pressure sensor.

4. The conveyor feed apparatus of claim 2, wherein the apparatus further comprises a power source, a controller, an agitator, and a switch, said power source powering operation of said sensor, said controller and said agitator, and wherein said power source is operably controlled by said switch.

5. The conveyor feed apparatus of claim 1, wherein said conveyor feed apparatus comprises two conveyors.

6. The conveyor feed apparatus of claim 5, wherein the conveyor feed apparatus further comprises a feed tube, and wherein said paintballs are transmitted from the lower end of said housing to the infeed portion of said paintball gun through said feed tube.

7. The conveyor feed apparatus of claim 6, wherein said housing includes first and second storage areas.

8. The conveyor feed apparatus of claim 6, wherein said housing and said paintball gun are only in contact by said feed tube.

9. The conveyor feed apparatus of claim 1, the conveyor further comprising:

a first wheel in contact with the conveyor belt such that rotation of the first wheel causes movement of the conveyor belt.

10. The conveyor feed apparatus of claim 9, the conveyor further comprising:

a second wheel in contact with the conveyor belt, the second wheel rotating in response to the movement of the conveyor belt.

11. The conveyor feed apparatus of claim 1, the conveyor further comprising:

a plurality of flexible paddles, said flexible paddles extending from the conveyor belt and being spaced apart to accommodate receiving the paintballs.

* * * * *